US009129590B2

(12) United States Patent
Kawashima et al.

(10) Patent No.: US 9,129,590 B2
(45) Date of Patent: Sep. 8, 2015

(54) AUDIO ENCODING DEVICE USING CONCEALMENT PROCESSING AND AUDIO DECODING DEVICE USING CONCEALMENT PROCESSING

(75) Inventors: Takuya Kawashima, Ishikawa (JP); Hiroyuki Ehara, Kanagawa (JP); Koji Yoshida, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 1389 days.

(21) Appl. No.: 12/528,671

(22) PCT Filed: Feb. 29, 2008

(86) PCT No.: PCT/JP2008/000404

§ 371 (c)(1),
(2), (4) Date: Aug. 26, 2009

(87) PCT Pub. No.: WO2008/108080

PCT Pub. Date: Sep. 12, 2008

(65) Prior Publication Data

US 2010/0049509 A1 Feb. 25, 2010

(30) Foreign Application Priority Data

Mar. 2, 2007 (JP) ..... 2007-053503

(51) Int. Cl.
*G10L 19/00* (2013.01)
*G10L 19/005* (2013.01)
*G10L 19/12* (2013.01)

(52) U.S. Cl.
CPC ..... *G10L 19/005* (2013.01); *G10L 19/12* (2013.01)

(58) Field of Classification Search
CPC ... G10L 19/00; G10L 19/005; G10L 19/0019; G10L 19/028; G10L 19/16; G10L 19/167
USPC ..... 704/219, 220, 222, 223, 500–504
See application file for complete search history.

(56) References Cited

U.S. PATENT DOCUMENTS 5,384,891 A * 1/1995 Asakawa et al. ..... 704/220
5,615,298 A * 3/1997 Chen ..... 704/228

(Continued)

FOREIGN PATENT DOCUMENTS

JP 2004-102074 4/2004
JP 2005-534950 11/2005

(Continued)

OTHER PUBLICATIONS

Benyassine, A.; Shlomot, E.; Su, H.-Y.; Massaloux, D.; Lamblin, C.; Petit, J.-P.; , "ITU-T Recommendation G.729 Annex B: a silence compression scheme for use with G.729 optimized for V.70 digital simultaneous voice and data applications," Communications Magazine, IEEE , vol. 35, No. 9, pp. 64-73, Sep. 1997.*

(Continued)

*Primary Examiner* — Paras D Shah
(74) *Attorney, Agent, or Firm* — Greenblum & Bernstein P.L.C.

(57) ABSTRACT

Disclosed are an audio encoding device and an audio decoding device which reduce degradation of subjective quality of a decoding signal caused by power mismatch of a decoding signal which is generated by a concealing process upon disappearance of a frame. When a frame is lost, a past encoding parameter is used to obtain a concealed LPC of the current frame and a concealed sound source parameter. A normal CELP decoding is performed from the obtained concealed sound source parameter. Correction is performed by using a conceal parameter on the obtained concealed LPC and the concealed sound source signal. The power of the corrected concealed sound source signal is adjusted to match a reference sound source power. A filter gain of the synthesis filter is adjusted so as to adjust the power of a decoded sound signal to the power of a decoded sound signal during an error-free state. Moreover, a synthesis filter gain adjusting coefficient is calculated by using an estimated normalized residual power so that a filter gain of a synthesis filter formed by using a concealed LPC is a filter gain during an error-free state.

6 Claims, 5 Drawing Sheets

(56) References Cited

U.S. PATENT DOCUMENTS

| | | | | |
|---|---|---|---|---|
| 6,115,687 | A | 9/2000 | Tanaka et al. | |
| 6,636,829 | B1 * | 10/2003 | Benyassine et al. | 704/201 |
| 6,665,637 | B2 * | 12/2003 | Bruhn | 704/206 |
| 6,757,654 | B1 * | 6/2004 | Westerlund et al. | 704/262 |
| 6,775,649 | B1 * | 8/2004 | DeMartin | 704/201 |
| 6,826,527 | B1 * | 11/2004 | Unno | 704/223 |
| 7,302,385 | B2 * | 11/2007 | Sung et al. | 704/219 |
| 7,324,937 | B2 * | 1/2008 | Thyssen et al. | 704/219 |
| 7,529,673 | B2 * | 5/2009 | Mäkinen et al. | 704/265 |
| 7,693,710 | B2 * | 4/2010 | Jelinek et al. | 704/207 |
| 2004/0010407 | A1 * | 1/2004 | Kovesi et al. | 704/219 |
| 2005/0154584 | A1 | 7/2005 | Jelinek et al. | |
| 2008/0281587 | A1 | 11/2008 | Yoshida | |
| 2009/0018824 | A1 | 1/2009 | Teo | |
| 2011/0125505 | A1 * | 5/2011 | Vaillancourt et al. | 704/500 |

FOREIGN PATENT DOCUMENTS

| | | |
|---|---|---|
| WO | 2008/007699 | 1/2008 |
| WO | 2008/007700 | 1/2008 |

OTHER PUBLICATIONS

U.S. Appl. No. 60/877,173, filed Dec. 2006, Gao et al.*

Vaseghi, Saeed. "Linear Prediction Models". Advanced Digital Signal Processing and Noise Reduction, second edition, John Wiley and Sons, 2000.*

English language Abstract of JP 2005-534950, Nov. 17, 2005.

English language Abstract of JP 2004-102074, Apr. 2, 2004.

U.S. Appl. No. 12/529,212 to Oshikiri, filed Aug. 31, 2009.

U.S. Appl. No. 12/528,661 to Sato et al, filed Aug. 26, 2009.

U.S. Appl. No. 12/528,659 to Osikiri et al, filed Aug. 26, 2009.

U.S. Appl. No. 12/528,869 to Oshikiri et al, filed Aug. 27, 2009.

U.S. Appl. No. 12/528,877 to Morii et al, filed Aug. 27, 2009.

U.S. Appl. No. 12/529,219 to Morii et al, filed Aug. 31, 2009.

U.S. Appl. No. 12/528,871 to Morii et al, filed Aug. 27, 2009.

U.S. Appl. No. 12/528,878 to Ehara, filed Aug. 27, 2009.

U.S. Appl. No. 12/528,880 to Ehara, filed Aug. 27, 2009.

* cited by examiner

AUDIO ENCODING DEVICE USING CONCEALMENT PROCESSING AND AUDIO DECODING DEVICE USING CONCEALMENT PROCESSING

TECHNICAL FIELD

The present invention relates to a speech encoding apparatus and speech decoding apparatus.

BACKGROUND ART

A VoIP (Voice over IP) speech codec is required to have good packet loss robustness. For example, with embedded variable bit-rate speech encoding (EV-VBR) being promoted by the ITU-T (International Telecommunication Union—Telecommunication Standardization Sector) as a next-generation VoIP codec, subjective quality of decoded speech required under frame loss conditions has been established based on subjective quality of error-free decoded speech.

Of decoded speech signal quality degradation due to frame loss, that which most affects sound reception quality is degradation related to power fluctuations involving loss of sound and excessively loud sound. Therefore, in order to improve frame loss compensation capability, it is important for a speech decoding apparatus to be able to decode suitable power information with a lost frame.

To enable a speech decoding apparatus to decode correct power information in the event of a frame loss, measures are taken to improve the ability to conceal lost power information by transmitting lost frame power information from a speech encoding apparatus to a speech decoding apparatus as redundant information. For example, with the technology disclosed in Patent Document 1, by transmitting decoded speech signal power as redundant information, the power of decoded speech generated by concealment processing is matched to decoded speech signal power received as redundant information. In order to perform matching to decoded speech signal power, excitation power is calculated back using received decoded speech signal power and impulse response power of a synthesis filter configured by means of a linear prediction coefficient obtained by concealment processing.

Thus, according to the technology disclosed in Patent Document 1, decoded speech signal power is used as redundant information for concealment processing, making it possible to match decoded speech signal power at the time of frame loss concealment processing to decoded speech signal power in an error-free state.

Patent Document 1: Japanese Patent Application Laid-Open No. 2005-534950

DISCLOSURE OF INVENTION

Problems to be Solved by the Invention

However, matching of excitation power at the time of frame loss concealment processing to excitation power in an error-free state cannot be guaranteed even if the technology disclosed in Patent Document 1 is used. Consequently, power of an excitation signal stored in an adaptive codebook is different at the time of frame loss concealment processing and in an error-free state, and this error is propagated in a frame in which post-frame-loss encoded data is received correctly (a recovered frame), and may be a cause of decoded speech signal quality degradation. This problem is explained in concrete terms below.

FIG. 1A shows change over time of filter gain of an LPC (linear prediction coefficient) filter (indicated by white circles in FIG. 1A), decoded excitation signal power (indicated by white triangles in FIG. 1A), and decoded speech signal power (indicated by white squares in FIG. 1A), in an error-free state. The horizontal axis represents the time domain in frame units, and the vertical axis represents magnitude of power.

FIG. 1B shows an example of power adjustment at the time of frame loss concealment processing. Frame loss occurs in frame K1 and frame K2, while encoded data is received normally in other frames. The respective error-free-state plot point indications are the same as in FIG. 1A, and straight lines joining error-free-state plot points are indicated by dashed lines. Power fluctuation is shown by the solid line in case where frame loss occurs in frame K1 and frame K2. Black triangles indicate excitation power, and black circles indicate filter gain.

First, a case in which frame K1 is lost will be described. Decoded speech signal power is transmitted from a speech encoding apparatus as redundant information for concealment processing, and despite being lost, frame K1 can be decoded correctly from data of the next frame. Decoded speech signal power generated by concealment processing can be matched to this correct decoded speech signal power.

Next, filter gain and excitation power will be described. Filter gain is not transmitted from a speech encoding apparatus as redundant information for concealment processing, and a filter generated by concealment processing uses a linear prediction coefficient decoded in the past. Consequently, gain of a synthesis filter generated by concealment processing (hereinafter referred to as "concealed filter gain") is close to filter gain of a synthesis filter decoded in the past. However, error-free-state filter gain is not necessarily close to filter gain of a synthesis filter decoded in the past. Consequently, there is a possibility of concealed filter gain being greatly different from error-free-state filter gain.

For example, for frame K1 in FIG. 1B, concealed filter gain is larger than error-free-state filter gain. In this case, it is necessary to lower excitation power at the time of frame loss concealment processing as compared with error-free-state excitation power in order to match decoded speech signal power to decoded speech signal power transmitted from a speech encoding apparatus. As a result, an excitation signal for which power has been adjusted so as to be smaller than error-free-state excitation power is input to an adaptive codebook. Thus, the power of an excitation signal in the adaptive codebook decreases even if encoded data can be received correctly from the next frame onward, and therefore a state arises in which excitation power is smaller in a recovered frame onward than in an error-free state. Consequently, decoded speech signal power becomes small, and there is a possibility of a listener sensing fading or loss of sound.

Next, a case in which frame K2 is lost will be described. The case of frame K2 is the opposite of that of frame K1. That is to say, this is a case in which concealed filter gain for a lost frame is smaller than in an error-free state, and excitation power is larger. In this case, a state arises in which excitation power is larger in a recovered frame than in an error-free state, and therefore decoded speech signal power becomes large, and there is a possibility of this causing a sense of abnormal sound.

In the technology disclosed in Patent Document 1, a simple method of solving these problems is to adjust excitation signal power in a recovered frame, but a separate problem arises of a decoded excitation signal stored in the adaptive codebook being discontinuous between a recovered frame and a lost frame.

The present invention has been implemented taking into account the problems described above, and it is an object of the present invention to provide a speech encoding apparatus and speech decoding apparatus that reduce degradation of subjective quality of a decoded signal caused by power fluctuation due to concealment processing in the event of a frame loss.

Means for Solving the Problem

A speech encoding apparatus of the present invention employs a configuration having: an excitation power calculation section that calculates power of an excitation signal; a normalized predicted residual power calculation section that calculates normalized predicted residual power; and a multiplexing section that multiplexes concealment processing parameters including calculated excitation signal power and normalized predicted residual power with another parameter.

A speech decoding apparatus of the present invention employs a configuration having: an excitation power adjustment section that adjusts power of an excitation signal generated by concealment processing in the event of a frame loss so as to match power of a received excitation signal; a normalized predicted residual power calculation section that calculates normalized predicted residual power of a linear prediction coefficient generated by concealment processing in the event of a frame loss; an adjustment coefficient calculation section that calculates a filter gain adjustment coefficient of a synthesis filter from a ratio between the calculated normalized predicted residual power and received normalized predicted residual power; an adjustment section that multiplies the excitation signal generated by concealment processing by the filter gain adjustment coefficient and adjusts filter gain of a synthesis filter; and a synthesis filter section that synthesizes a decoded speech signal using the linear prediction coefficient generated by concealment processing and the excitation signal multiplied by the filter gain adjustment coefficient.

Advantageous Effects of Invention

The present invention enables degradation of subjective quality of a decoded signal caused by power fluctuation due to concealment processing in the event of a frame loss to be reduced.

BEST MODE FOR CARRYING OUT THE INVENTION

Now, an embodiment of the present invention will be described in detail with reference to the accompanying drawings.

Embodiment

Figure 1A:
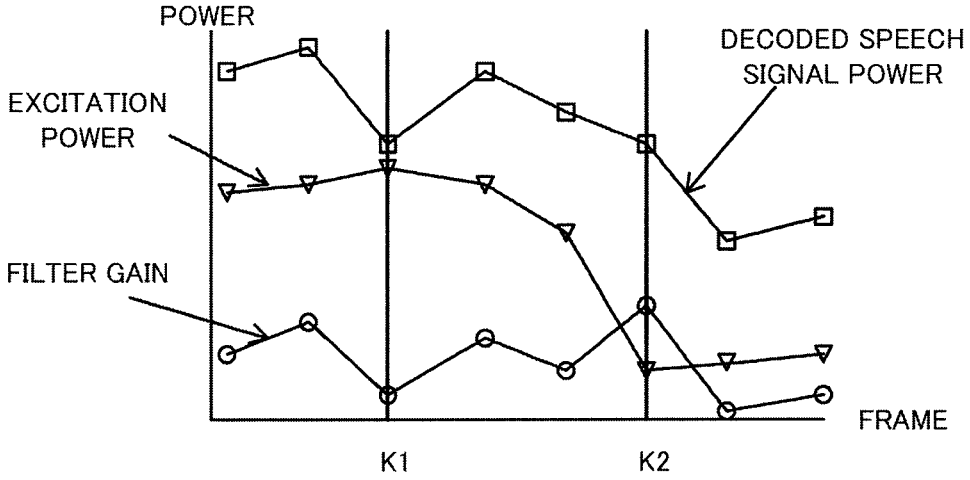
FIG. 1A is a drawing showing change over time of filter gain of an LPC filter, decoded excitation signal power, and decoded speech signal power, in an error-free state.
Figure 1B:
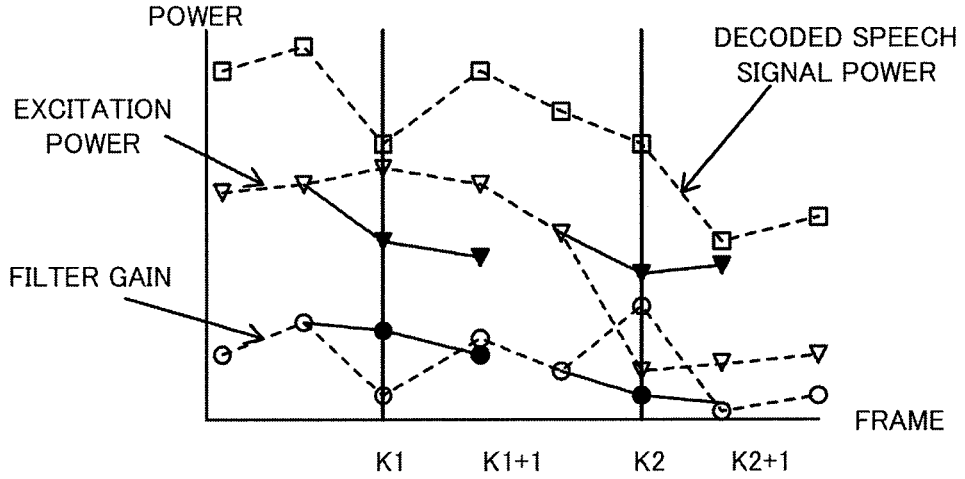
FIG. 1B is a drawing showing an example of power adjustment at the time of frame loss concealment processing.
Figure 2:
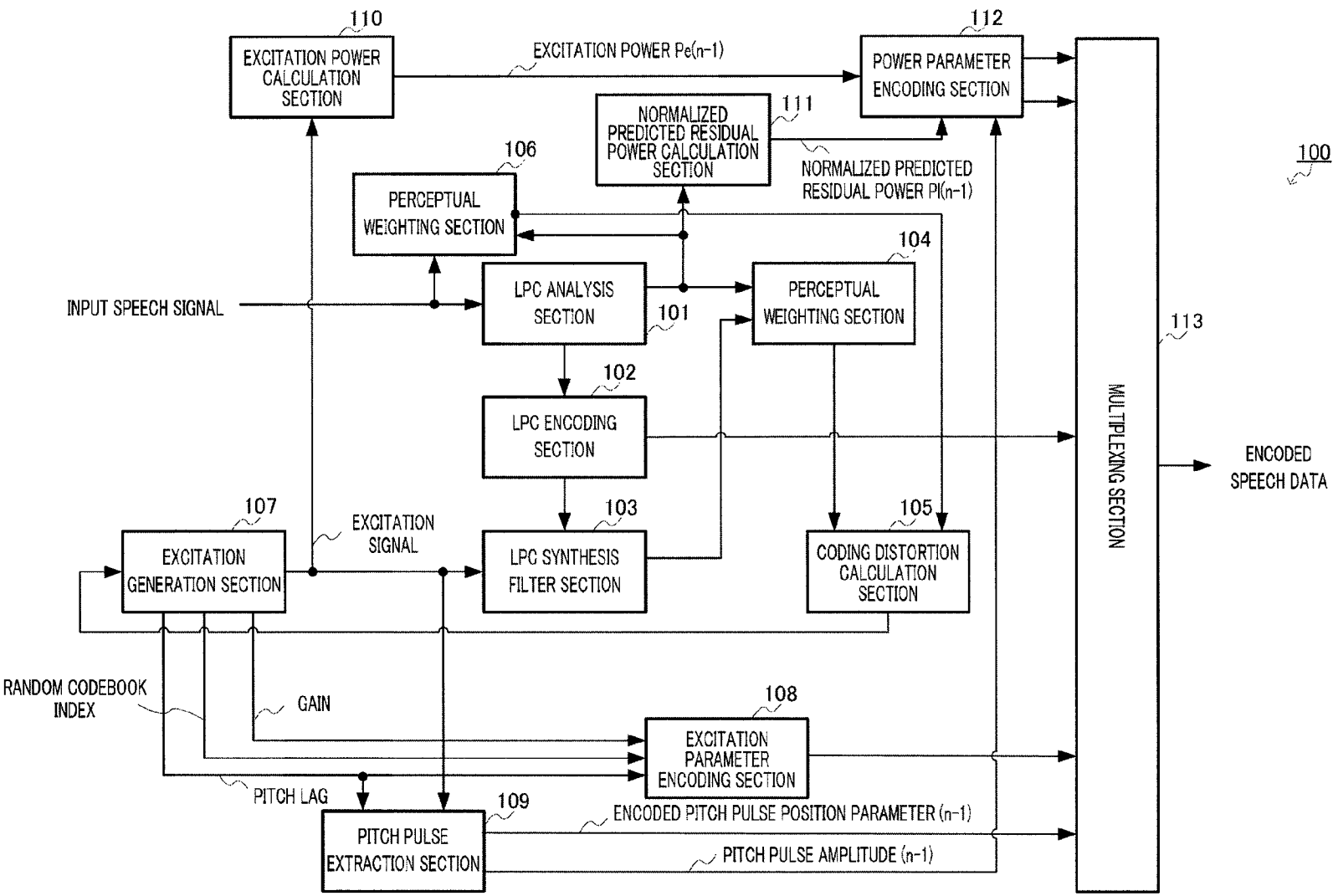
FIG. 2 is a block diagram showing a configuration of a speech encoding apparatus according to an embodiment of the present invention.

FIG. 2 is a block diagram showing the configuration of speech encoding apparatus 100 according to an embodiment of the present invention. The sections configuring speech encoding apparatus 100 are described below.

LPC analysis section 101 performs linear predictive analysis (LPC analysis) on an input speech signal, and outputs an obtained linear prediction coefficient (hereinafter referred to as "LPC") to LPC encoding section 102, perceptual weighting section 104, perceptual weighting section 106, and normalized predicted residual power calculation section 111.

LPC encoding section 102 quantizes and encodes the LPC output from LPC analysis section 101, and outputs an obtained quantized LPC to LPC synthesis filter section 103, and an encoded LPC parameter to multiplexing section 113.

Taking the quantized LPC output from LPC encoding section 102 as a filter coefficient, LPC synthesis filter section 103 drives an LPC synthesis filter by means of an excitation signal output from excitation generation section 107, and outputs a synthesized signal to perceptual weighting section 104.

Perceptual weighting section 104 configures a perceptual weighting filter by means of a filter coefficient resulting from multiplying the LPC output from LPC analysis section 101 by a weighting coefficient, executes perceptual weighting on the synthesized signal output from LPC synthesis filter section 103, and outputs the resulting signal to coding distortion calculation section 105.

Coding distortion calculation section 105 calculates a difference between the synthesized signal on which perceptual weighting has been executed output from perceptual weighting section 104 and the input speech signal on which perceptual weighting has been executed output from perceptual weighting section 106, and outputs the calculated difference to excitation generation section 107 as coding distortion.

Perceptual weighting section 106 configures a perceptual weighting filter by means of a filter coefficient resulting from multiplying the LPC output from LPC analysis section 101 by a weighting coefficient, executes perceptual weighting on the input speech signal, and outputs the resulting signal to coding distortion calculation section 105.

Excitation generation section 107 outputs an excitation signal for which coding distortion output from coding distortion calculation section 105 is at a minimum to LPC synthesis filter section 103 and excitation power calculation section 110. Excitation generation section 107 also outputs an excitation signal and pitch lag when coding distortion is at a minimum to pitch pulse extraction section 109, and outputs excitation parameters such as a random codebook index, random codebook gain, pitch lag, and pitch gain when coding distortion is at a minimum to excitation parameter encoding section 108. In FIG. 2, random codebook gain and pitch gain are output as one kind of gain information by means of vector quantization or the like. A mode may also be used in which random codebook gain and pitch gain are output separately.

Excitation parameter encoding section 108 encodes excitation parameters such as a random codebook index, gain (including random codebook gain and pitch gain), and pitch lag, output from excitation generation section 107, and outputs the obtained encoded excitation parameters to multiplexing section 113.

Pitch pulse extraction section 109 detects a pitch pulse of an excitation signal output from excitation generation section 107 using pitch lag information output from excitation generation section 107, and calculates a pitch pulse position and amplitude. Here, a pitch pulse denotes a sample for which amplitude is maximal within one pitch period length of the excitation signal. The pitch pulse position is encoded and an obtained encoded pitch pulse position parameter is output to multiplexing section 113. Meanwhile, the pitch pulse amplitude is output to power parameter encoding section 112. A pitch pulse is detected, for example, by searching for a point of maximum amplitude present in a pitch-lag-length range from the end of a frame. In this case, the position and amplitude of a sample having an amplitude for which the amplitude absolute value is at a maximum are the pitch pulse position and pitch pulse amplitude respectively.

Excitation power calculation section 110 calculates excitation power of the current frame output from excitation generation section 107, and outputs the calculated current-frame excitation power to power parameter encoding section 112. Excitation power Pe(n) for frame n is calculated by means of Equation (1) below.

(Equation 1)

$$Pe(n) = \frac{1}{\text{L_FRAME}} \sum_{i=0}^{L_FRAME-1} exc_n[i]^* exc_n[i] \quad [1]$$

Here, L_FRAME indicates a frame length, $exc_n[\,]$ a speech signal, and i a sample number.

Normalized predicted residual power calculation section 111 calculates normalized predicted residual power from an LPC output from LPC analysis section 101, and outputs the calculated normalized predicted residual power to power parameter encoding section 112. Frame n normalized predicted residual power Pz(n) is calculated, for example, by converting from an LPC to a reflection coefficient using Equation (2) below.

(Equation 2)

$$Pz(n) = \prod_{j=1}^{M} (1 - r[j]^2) \quad [2]$$

Here, M is a prediction order and r[j] is a j-order reflection coefficient. Normalized predicted residual power may be calculated in the process of calculating a linear prediction coefficient by means of a Levinson-Durbin algorithm. In this case, normalized predicted residual power is output from LPC analysis section 101 to power parameter encoding section 112.

Power parameter encoding section 112 performs vector quantization of excitation power output from excitation power calculation section 110, normalized predicted residual power output from normalized predicted residual power calculation section 111, and pitch pulse amplitude output from pitch pulse extraction section 109, and outputs an obtained index to multiplexing section 113 as an encoded power parameter. The positive/negative status of pitch pulse amplitude is encoded separately, and is output to multiplexing section 113 as encoded pitch pulse amplitude polarity. Here, excitation signal power, normalized predicted residual power, and pitch pulse amplitude are concealment processing parameters used in concealment processing in a speech decoding apparatus. Details of power parameter encoding section 112 will be given later herein.

If the frame number of a speech signal input to speech encoding apparatus 100 is denoted by n (where n is an integer greater than 0), multiplexing section 113 multiplexes a frame n encoded LPC parameter output from LPC encoding section 102, a frame n encoded excitation parameter output from excitation parameter encoding section 108, a frame n−1 encoded pitch pulse position parameter output from pitch pulse extraction section 109, and a frame n−1 encoded power parameter and encoded pitch pulse amplitude polarity output from power parameter encoding section 112, and outputs obtained multiplexed data as frame n encoded speech data.

Thus, according to speech encoding apparatus 100, encoded parameters are calculated from input speech by means of a CELP (Code Excited Linear Prediction) speech encoding method, and output as speech encoded data. Also, in order to improve frame error robustness, data in which preceding-frame concealment processing parameters are encoded and current-frame speech encoded data are transmitted in multiplexed form.

Figure 3:
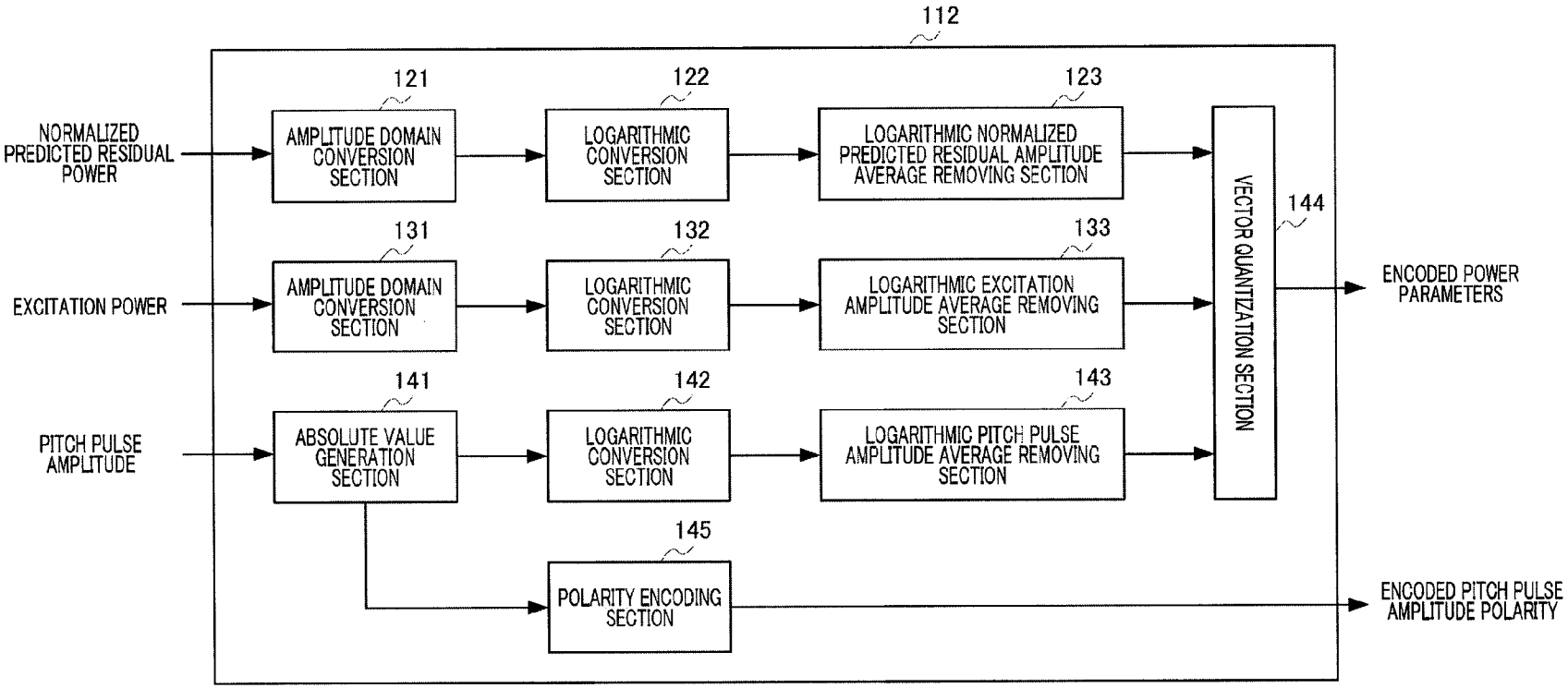
FIG. 3 is a block diagram showing the internal configuration of the power parameter encoding section shown in FIG. 2.

FIG. 3 is a block diagram showing the internal configuration of power parameter encoding section 112 shown in FIG. 2. The sections configuring power parameter encoding section 112 are described below.

Amplitude domain conversion section 121 converts normalized predicted residual power from the power domain to the amplitude domain by calculating the square root of normalized predicted residual power output from normalized predicted residual power calculation section 111, and outputs the result to logarithmic conversion section 122.

Logarithmic conversion section 122 finds a base-10 logarithm of normalized predicted residual power output from amplitude domain conversion section 121, and performs logarithmic conversion. A logarithmic-converted normalized predicted residual amplitude is output to logarithmic normalized predicted residual amplitude average removing section 123.

Logarithmic normalized predicted residual amplitude average removing section 123 subtracts an average value from a logarithmic normalized predicted residual amplitude output from logarithmic conversion section 122, and outputs the subtraction result to vector quantization section 144. The logarithmic normalized predicted residual amplitude average value is assumed to be calculated beforehand using a large-scale input signal database.

Amplitude domain conversion section 131 converts excitation power from the power domain to the amplitude domain by calculating the square root of excitation power output from excitation power calculation section 110, and outputs the result to logarithmic conversion section 132.

Logarithmic conversion section 132 finds a base-10 logarithm of excitation amplitude output from amplitude domain conversion section 131, and performs logarithmic conversion. A logarithmic-converted excitation amplitude is output to logarithmic excitation amplitude average removing section 133.

Logarithmic excitation amplitude average removing section 133 subtracts an average value from a logarithmic excitation amplitude output from logarithmic conversion section 132, and outputs the subtraction result to vector quantization section 144. The logarithmic excitation amplitude average value is assumed to be calculated beforehand using a large-scale input signal database.

Absolute value generation section 141 finds an absolute value of pitch pulse amplitude output from pitch pulse extraction section 109, outputs the pitch pulse amplitude absolute value to logarithmic conversion section 142, and outputs the pitch pulse amplitude polarity to polarity encoding section 145.

Logarithmic conversion section 142 finds a base-10 logarithm of the pitch pulse amplitude absolute value output from absolute value generation section 141, and performs logarithmic conversion. A logarithmic-converted pitch pulse amplitude is output to logarithmic pitch pulse amplitude average removing section 143.

Logarithmic pitch pulse amplitude average removing section 143 subtracts an average value from a logarithmic pitch pulse amplitude output from logarithmic conversion section 142, and outputs the subtraction result to vector quantization section 144. The logarithmic pitch pulse amplitude average value is assumed to be calculated beforehand using a large-scale input signal database.

Vector quantization section 144 performs vector quantization of the logarithmic normalized predicted residual amplitude, logarithmic excitation amplitude, and logarithmic pitch pulse amplitude as a three-dimensional vector, and outputs an obtained index to multiplexing section 113 as an encoded power parameter.

Polarity encoding section 145 encodes the positive/negative status of pitch pulse amplitude output from absolute value generation section 141, and outputs encoded pitch pulse amplitude polarity to multiplexing section 113.

Thus, power parameter encoding section 112 efficiently quantizes an input power parameter by removing an average value for a unified parameter domain, and performing vector quantization after coordinating the dynamic range.

Figure 4:
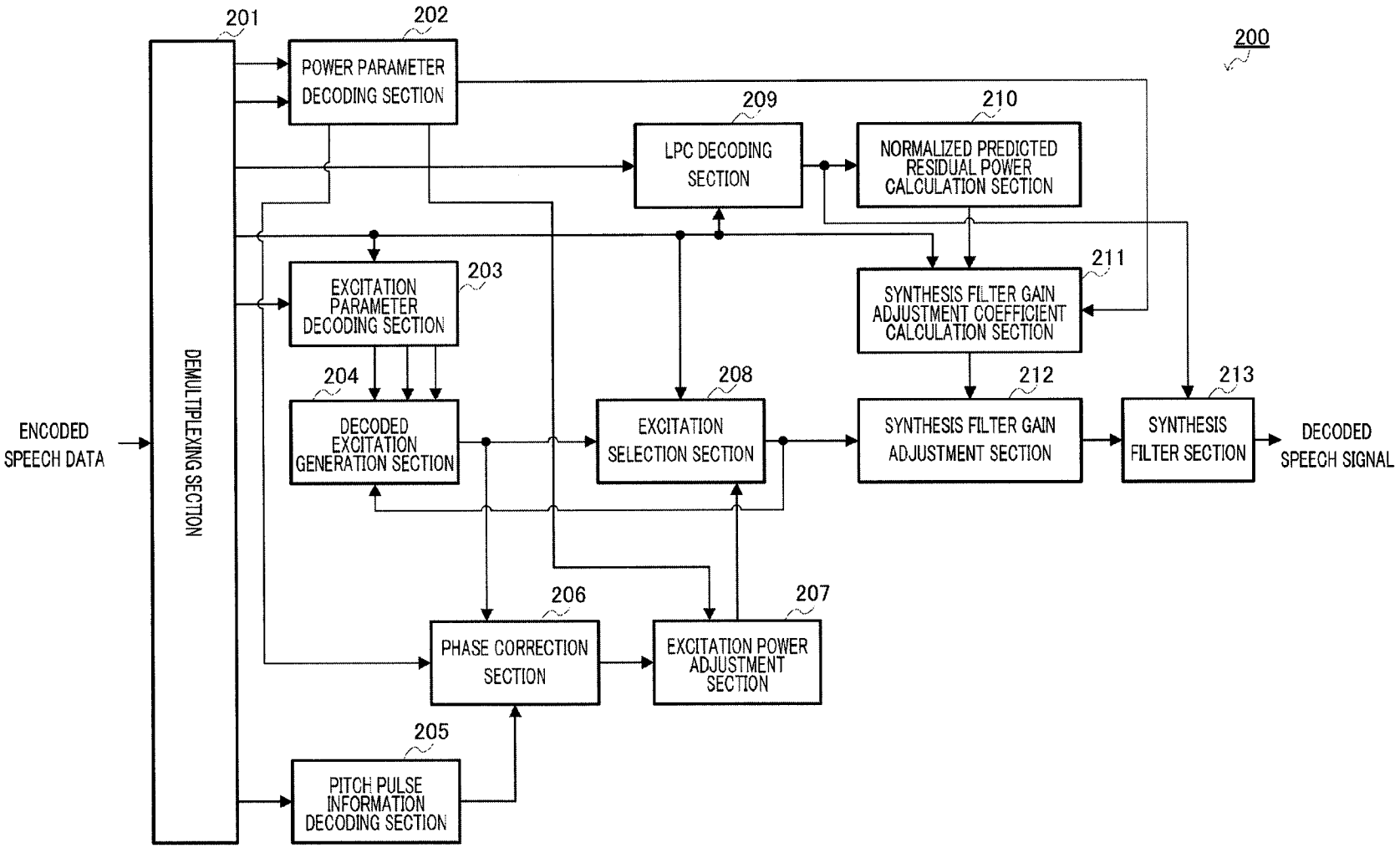
FIG. 4 is a block diagram showing a configuration of a speech decoding apparatus according to an embodiment of the present invention.

FIG. 4 is a block diagram showing the configuration of speech decoding apparatus 200 according to an embodiment of the present invention. The sections configuring speech decoding apparatus 200 are described below.

Demultiplexing section 201 receives encoded speech data transmitted from speech encoding apparatus 100, and separates an encoded power parameter, encoded pitch pulse amplitude polarity, encoded excitation parameter, encoded pitch pulse position parameter, and encoded LPC parameter. Demultiplexing section 201 outputs an obtained encoded power parameter and encoded pitch pulse amplitude polarity to power parameter decoding section 202, outputs an encoded excitation parameter to excitation parameter decoding section 203, outputs an encoded pitch pulse position parameter to pitch pulse information decoding section 205, and outputs an encoded LPC parameter to LPC decoding section 209. Demultiplexing section 201 also receives frame loss information, and outputs this to excitation parameter decoding section 203, excitation selection section 208, LPC decoding section 209, and synthesis filter gain adjustment coefficient calculation section 211.

Power parameter decoding section 202 decodes an encoded power parameter and encoded pitch pulse amplitude polarity output from demultiplexing section 201, and obtains excitation power, normalized predicted residual power, and pitch pulse amplitude encoded by speech encoding apparatus 100. In order to avoid confusion, these decoded power parameters will be referred to as reference excitation power, reference normalized predicted residual power, and reference pitch pulse amplitude, respectively. Power parameter decoding section 202 outputs obtained reference pitch pulse amplitude to phase correction section 206, outputs reference excitation power to excitation power adjustment section 207, and outputs reference normalized predicted residual power to synthesis filter gain adjustment coefficient calculation section 211. Details of power parameter decoding section 202 will be given later herein.

Excitation parameter decoding section 203 decodes encoded excitation parameters output from demultiplexing section 201 and obtains excitation parameters such as a random codebook index, gain (random codebook gain and pitch gain), and pitch lag. The obtained excitation parameters are output to decoded excitation generation section 204.

Decoded excitation generation section 204 performs decoding processing or frame loss concealment processing based on a CELP model, using excitation parameters output from excitation parameter decoding section 203 and an excitation signal fed back from excitation selection section 208, generates a decoded excitation signal, and outputs the generated decoded excitation signal to phase correction section 206 and excitation selection section 208.

Pitch pulse information decoding section 205 decodes an encoded pitch pulse position parameter output from demultiplexing section 201, and outputs an obtained pitch pulse position to phase correction section 206.

Using the pitch pulse position output from pitch pulse information decoding section 205 and reference pitch pulse amplitude output from power parameter decoding section 202 for the decoded excitation signal output from decoded excitation generation section 204, phase correction section 206 corrects the phase of an excitation signal generated by concealment processing, and outputs a phase-corrected excitation signal to excitation power adjustment section 207. Phase correction section 206 corrects the phase of the excitation signal generated by concealment processing so that a sample having a pitch pulse amplitude value is positioned at the received pitch pulse position. In this embodiment, for the sake of simplicity, the relevant section of an excitation signal is replaced by an impulse having a pitch pulse amplitude value at the received pitch pulse position. By this means, when accurate pitch lag is received in a subsequent frame, the phase of a pitch waveform output from the adaptive codebook can be matched to the correct phase.

Excitation power adjustment section 207 adjusts the power of a phase-corrected excitation signal output from phase correction section 206 so as to match reference excitation power output from power parameter decoding section 202, and outputs a post-power-adjustment phase-corrected excitation signal to excitation selection section 208 as a power-adjusted excitation signal. Specifically, excitation power adjustment section 207 calculates frame n phase-corrected excitation signal power DPe(n) by means of Equation (3).

(Equation 3)

$$DPe(n) = \frac{1}{\text{L_FRAME}} \sum_{i=0}^{L_FRAME-1} dpexc_n[i] * dpexc_n[i] \quad [3]$$

Here, $dpexc_n[\ ]$ represents a pitch-pulse-corrected excitation signal, and i represents a sample number.

Next, excitation power adjustment section 207 calculates an excitation power adjustment coefficient that performs adjustment so as to match the reference excitation power received from speech encoding apparatus 100. Frame n excitation power adjustment coefficient re(n) is calculated by means of Equation (4).

[4]

$$re(n)=\sqrt{Pe(n)/DPe(n)} \quad \text{(Equation 4)}$$

Here, Pe(n) represents frame n reference excitation power.

Excitation power adjustment section 207 adjusts phase-corrected excitation signal power so as to match the reference excitation power by multiplying phase-corrected excitation signal power DPe(n) by excitation power adjustment coefficient re(n) obtained by means of above Equation (4).

Excitation selection section 208 selects a power-adjusted excitation signal output from excitation power adjustment section 207 if frame loss information output from demultiplexing section 201 indicates a frame loss, or selects a decoded excitation signal output from decoded excitation generation section 204 if the frame loss information does not indicate a frame loss. Excitation selection section 208 outputs the selected excitation signal to decoded excitation generation section 204 and synthesis filter gain adjustment section 212. The excitation signal output to decoded excitation generation section 204 is stored in an adaptive codebook inside decoded excitation generation section 204.

LPC decoding section 209 decodes an encoded LPC parameter output from demultiplexing section 201, and outputs an obtained LPC to normalized predicted residual power calculation section 210 and synthesis filter section 213. Also, if aware from frame loss information output from demultiplexing section 201 that the current frame is a lost frame, LPC decoding section 209 generates a current-frame LPC from a past LPC by means of concealment processing. Below, an LPC generated by concealment processing is referred to as a concealed LPC.

Normalized predicted residual power calculation section 210 calculates normalized predicted residual power from an LPC (or concealed LPC) output from LPC decoding section 209, and outputs the calculated normalized predicted residual power to synthesis filter gain adjustment coefficient calculation section 211. When a concealed LPC is found, normalized predicted residual power is obtained in the process of converting from a concealed LPC to a reflection coefficient. Frame n normalized predicted residual power DPz(n) is calculated by means of Equation (5).

(Equation 5)

[5]

$$DPz(n) = \prod_{j=1}^{M} (1 - dr[j]^2)$$

Here, M is a prediction order and dr[j] is a j-order reflection coefficient. Normalized predicted residual power calculation section 210 may also used the same method as used by normalized predicted residual power calculation section 111 of speech encoding apparatus 100.

Synthesis filter gain adjustment coefficient calculation section 211 calculates a synthesis filter gain adjustment coefficient based on normalized predicted residual power output from normalized predicted residual power calculation section 210, reference normalized predicted residual power output from power parameter decoding section 202, and frame loss information output from demultiplexing section 201, and outputs the calculated synthesis filter gain adjustment coefficient to synthesis filter gain adjustment section 212. Frame n synthesis filter gain adjustment coefficient rz(n) is calculated by means of Equation (6).

[6]

$$rz(n)=\sqrt{DPz(n)/PZ(n)} \quad \text{(Equation 6)}$$

Here, Pz(n) represents frame n reference normalized predicted residual power. If aware from frame loss information that the current frame is not a lost frame, synthesis filter gain adjustment coefficient calculation section 211 may output 1.0 to synthesis filter gain adjustment section 212 without performing calculation.

Synthesis filter gain adjustment section 212 adjusts excitation signal energy by multiplying the excitation signal output from excitation selection section 208 by the synthesis filter gain adjustment coefficient output from synthesis filter gain adjustment coefficient calculation section 211, and outputs the resulting signal to synthesis filter section 213 as a synthesis-filter-gain-adjusted excitation signal.

Synthesis filter section 213 synthesizes a decoded speech signal using the synthesis-filter-gain-adjusted excitation signal output from synthesis filter gain adjustment section 212 and an LPC (or concealed LPC) output from LPC decoding section 209, and outputs this decoded speech signal.

Thus, according to speech decoding apparatus 200, it is possible to implement matching of both excitation signal power and decoded speech signal power at the time of frame loss concealment processing and in an error-free state by adjusting excitation signal power and synthesis filter gain individually. Consequently, provision can be made for power of an excitation signal stored in an adaptive codebook not to differ greatly from power of an excitation signal in an error-free state, enabling loss of sound and abnormal sound that may arise in a recovered frame onward to be reduced. Moreover, matching is also possible for synthesis filter gain and gain in an error-free state, enabling implementation of matching for decoded speech signal power and power in an error-free state.

Figure 5:
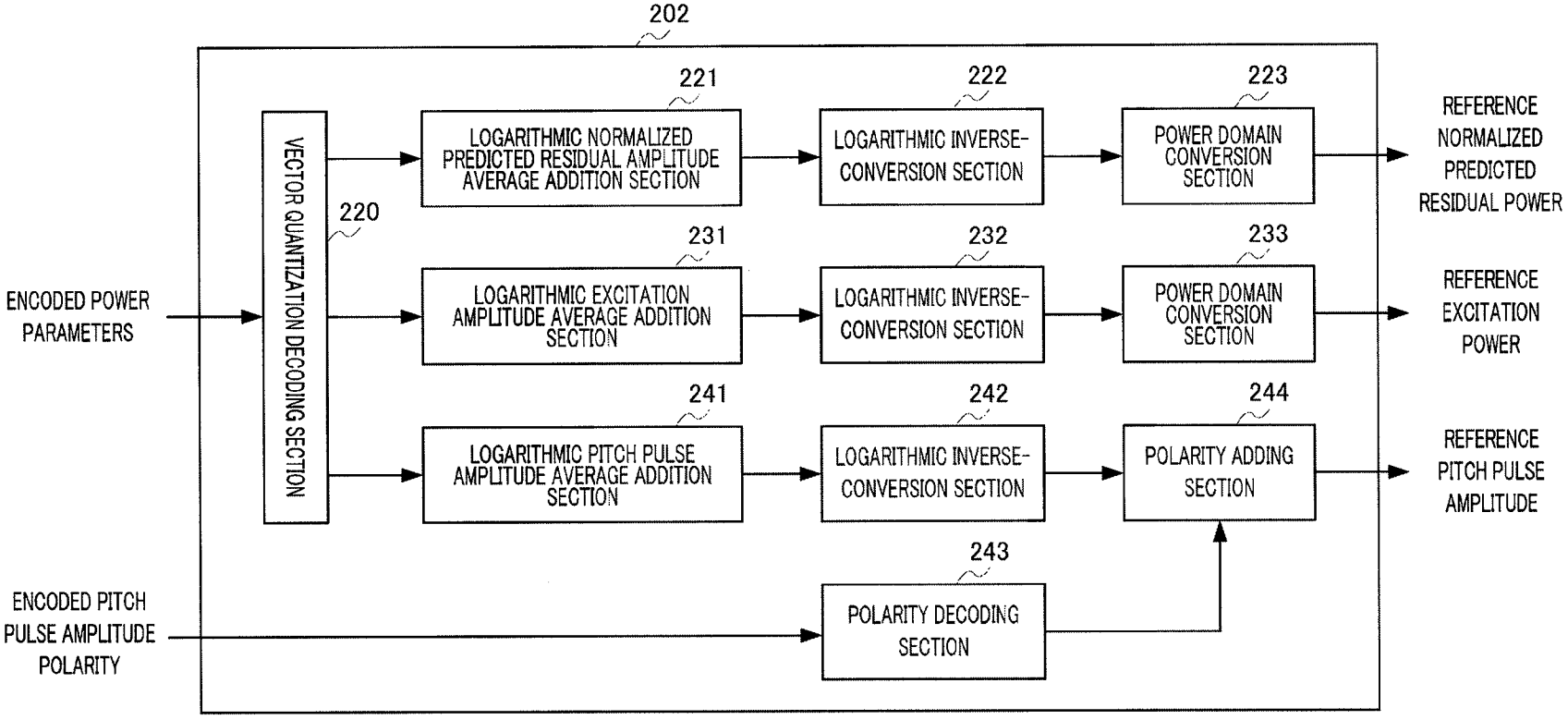
FIG. 5 is a block diagram showing the internal configuration of the power parameter decoding section shown in FIG. 4.

FIG. 5 is a block diagram showing the internal configuration of power parameter decoding section 202 shown in FIG. 4. The sections configuring power parameter decoding section 202 are described below.

Vector quantization decoding section 220 decodes an encoded power parameter output from demultiplexing section 201, obtains an average-removed logarithmic normalized predicted residual amplitude, an average-removed logarithmic excitation amplitude, and an average-removed logarithmic pitch pulse amplitude, and outputs these to logarithmic normalized predicted residual amplitude average addition section 221, logarithmic excitation amplitude average addition section 231, and logarithmic pitch pulse amplitude average addition section 241, respectively.

Logarithmic normalized predicted residual amplitude average addition section 221 adds a previously stored logarithmic normalized predicted residual amplitude average value to an average-removed logarithmic normalized predicted residual amplitude output from vector quantization decoding section 220, and outputs the result of the addition to logarithmic inverse-conversion section 222. The stored logarithmic normalized predicted residual amplitude average value here is the same as the average value stored in logarithmic normalized predicted residual amplitude average removing section 123 of power parameter encoding section 112.

Logarithmic inverse-conversion section 222 restores amplitude converted to the logarithmic domain by power parameter encoding section 112 to the linear domain by calculating a power of ten for which the logarithmic normalized predicted residual amplitude output from logarithmic normalized predicted residual amplitude average addition section 221 is the exponent. The obtained normalized predicted residual amplitude is output to power domain conversion section 223.

Power domain conversion section 223 performs conversion from the amplitude domain to the power domain by calculating the square of the normalized predicted residual amplitude output from logarithmic inverse-conversion section 222, and outputs the result to synthesis filter gain adjustment coefficient calculation section 211 as reference normalized predicted residual power.

Logarithmic excitation amplitude average addition section 231 adds a previously stored logarithmic excitation amplitude average value to an average-removed logarithmic excitation amplitude output from vector quantization decoding section 220, and outputs the result of the addition to logarithmic inverse-conversion section 232. The stored logarithmic excitation amplitude average value here is the same as the average value stored in logarithmic excitation amplitude average removing section 133 of power parameter encoding section 112.

Logarithmic inverse-conversion section 232 restores amplitude converted to the logarithmic domain by power parameter encoding section 112 to the linear domain by calculating a power of ten for which the logarithmic excitation amplitude output from logarithmic excitation amplitude average addition section 231 is the exponent. The obtained excitation amplitude is output to power domain conversion section 233.

Power domain conversion section 233 performs conversion from the amplitude domain to the power domain by calculating the square of the excitation amplitude output from logarithmic inverse-conversion section 232, and outputs the result to excitation power adjustment section 207 as reference excitation power.

Logarithmic pitch pulse amplitude average addition section 241 adds a previously stored logarithmic pitch pulse amplitude average value to an average-removed logarithmic pitch pulse amplitude output from vector quantization decoding section 220, and outputs the result of the addition to logarithmic inverse-conversion section 242. The stored logarithmic pitch pulse amplitude average value here is the same as the average value stored in logarithmic pitch pulse amplitude average removing section 143 of power parameter encoding section 112.

Logarithmic inverse-conversion section 242 restores amplitude converted to the logarithmic domain by power parameter encoding section 112 to the linear domain by calculating a power of ten for which the logarithmic pitch pulse amplitude output from logarithmic pitch pulse amplitude average addition section 241 is the exponent. The obtained pitch pulse amplitude is output to polarity adding section 244.

Polarity decoding section 243 decodes encoded pitch pulse amplitude polarity output from demultiplexing section 201, and outputs the pitch pulse amplitude polarity to polarity adding section 244.

Polarity adding section 244 adds the positive/negative status of pitch pulse amplitude output from polarity decoding section 243 to pitch pulse amplitude output from logarithmic inverse-conversion section 242, and outputs the result to phase correction section 206 as reference pitch pulse amplitude.

Next, the operation of speech decoding apparatus 200 shown in FIG. 4 will be described. When there is no frame loss, speech decoding apparatus 200 performs normal CELP decoding and obtains a decoded speech signal.

On the other hand, when a frame is lost and concealment processing information for concealing that frame is obtained, speech decoding apparatus 200 operation differs from that of normal CELP decoding. This operation is described in detail below.

First, in the event of a frame loss, LPC decoding section 209 and excitation parameter decoding section 203 perform current frame parameter concealment processing using a past encoded parameter. By this means, a concealed LPC and concealed excitation parameter are obtained. A concealed excitation signal is obtained by perform normal CELP decoding from an obtained concealed excitation parameter.

Correction is performed here on an obtained concealed LPC and concealed excitation signal using a concealment parameter. The object of a concealment parameter according to this embodiment is to reduce the difference between decoded speech signal power in the event of a frame loss and power in an error-free state, and to reduce the difference between power of a concealed excitation signal and power of a decoded excitation signal in an error-free state. However, abnormal sound is prone to occur if concealed excitation signal power is simply matched to decoded excitation signal power in an error-free state. Consequently, excitation maximum amplitude and phase are adjusted by using a pitch pulse position and amplitude together as concealment parameters, and concealed excitation signal quality is thereby improved.

Power adjustment is performed on a concealed excitation signal adjusted in this way so that obtained concealed excitation signal power matches reference excitation power. Then decoded speech signal power is matched to decoded speech signal power in an error-free state by adjusting the filter gain of a synthesis filter. In this embodiment, the filter gain of a synthesis filter is represented using normalized predicted residual power. That is to say, a synthesis filter gain adjustment coefficient is calculated using normalized predicted residual power so that the filter gain of a synthesis filter configured using a concealed LPC matches the filter gain in an error-free state.

A decoded speech signal is obtained by multiplying a power-adjusted concealed excitation signal by an obtained synthesis filter gain adjustment coefficient, and inputting this to a synthesis filter. By adjusting decoded excitation power and the filter gain of a synthesis filter so as to match those of an error-free state in this way, a decoded speech signal can be obtained that has a small degree of error compared with decoded speech signal power in an error-free state.

Thus, according to this embodiment, by using reference excitation power and reference normalized predicted residual power as redundant information for concealment processing, degradation of subjective quality caused by decoded signal power mismatching involving loss of sound and excessively loud sound can be prevented since decoded speech signal power in a lost frame is matched to decoded speech signal power in an error-free state. Also, by using reference excitation power, not only decoded speech signal power but also decoded excitation power can be matched to reference excitation power, enabling degradation of subjective quality caused by decoded power mismatching in a recovered frame onward to be suppressed. Moreover, transmitting power-related parameters quantized by means of vector quantization only requires an equivalent or slightly increased number of bits compared with a case in which one or other type of information is transmitted, enabling power-related redundant information for concealment processing to be transmitted as a small amount of information.

In this embodiment a case has been described in which normalized predicted residual power is transmitted as redundant information for concealment processing, but the present invention is not limited to this, and a parameter representing filter gain of an LPC synthesis filter in an equivalent manner, such as LPC prediction gain (synthesis filter gain), impulse response power, or the like, may also be transmitted.

Excitation power and normalized predicted residual power may also be transmitted vector-quantized in subframe units.

In this embodiment a case has been described in which pitch pulse information items (amplitude and position) are also transmitted as redundant information for concealment processing, but a mode in which pitch pulse information is not used is also possible. Furthermore, any mode may be used as long as a configuration is provided that implements matching of the phase of a concealed excitation signal.

In this embodiment a case has been described in which, in the event of a frame loss, phase correction and excitation power adjustment are performed by means of a pitch pulse after concealment processing has been performed by decoded excitation generation section 204, but a concealed excitation signal may also be generated by decoded excitation generation section 204 using pitch pulse information or reference excitation power. That is to say, provision may also be made for pitch lag to be corrected so that a concealed excitation signal pitch pulse is positioned at a pitch pulse position, and for pitch gain and random codebook gain to be adjusted so that concealed excitation power matches reference excitation power.

In this embodiment a case has been described in which, in order to adjust excitation power, excitation energy is adjusted using excitation power normalized on a buffer length basis, but energy may also be adjusted directly without being normalized.

In this embodiment, power parameters undergo logarithmic conversion after being converted from the power domain to the amplitude domain (base-10 logarithmic conversion is performed after a square root is calculated), but the same result is also obtained by dividing a logarithmic-converted value by 2 (dividing by 2 after performing base-10 logarithmic conversion also being equivalent).

In this embodiment a case has been described by way of example in which a speech decoding apparatus according to this embodiment receives and processes encoded speech data transmitted from a speech encoding apparatus according to this embodiment. However, the present invention is not limited to this, and encoded speech data received and processed by a speech decoding apparatus according to this embodiment may also be transmitted by a speech encoding apparatus with a different configuration that is capable of generating encoded speech data that can be processed by this speech decoding apparatus.

In the above embodiment a case has been described by way of example in which the present invention is configured as hardware, but it is also possible for the present invention to be implemented by software.

The function blocks used in the description of the above embodiment are typically implemented as LSI's, which are integrated circuits. These may be implemented individually as single chips, or a single chip may incorporate some or all of them. Here, the term LSI has been used, but the terms IC, system LSI, super LSI, and ultra LSI may also be used according to differences in the degree of integration.

The method of implementing integrated circuitry is not limited to LSI, and implementation by means of dedicated circuitry or a general-purpose processor may also be used. An FPGA (Field Programmable Gate Array) for which programming is possible after LSI fabrication, or a reconfigurable processor allowing reconfiguration of circuit cell connections and settings within an LSI, may also be used.

In the event of the introduction of an integrated circuit implementation technology whereby LSI is replaced by a different technology as an advance in, or derivation from, semiconductor technology, integration of the function blocks may of course be performed using that technology. The application of biotechnology or the like is also a possibility.

The disclosure of Japanese Patent Application No. 2007-053503, filed on Mar. 2, 2007, including the specification, drawings and abstract, is incorporated herein by reference in its entirety.

INDUSTRIAL APPLICABILITY

A speech encoding apparatus and speech decoding apparatus according to the present invention enable degradation of subjective quality caused by decoded signal power mismatching to be prevented even when concealment processing is performed in the event of a frame loss, and are suitable for use in a radio communication base station apparatus and radio communication terminal apparatus of a mobile communication system or the like, for example.

The invention claimed is:

1. A speech encoding and decoding apparatus comprising:

an LPC analyzer that performs linear predictive analysis on each of a first frame and a second frame of an input speech signal to generate an LPC parameter of each of the first frame and the second frame, the input speech signal including the second frame and the first frame preceding the second frame;

an LPC encoder that encodes the LPC parameter of the second frame;

an excitation generator that generates an excitation signal and an excitation parameter of each of the first frame and the second frame;

an excitation parameter encoder that encodes the excitation parameter of the second frame;

an excitation power calculator that calculates power of the excitation signal of the first frame;

a normalized predicted residual power calculator that calculates normalized predicted residual power based upon the LPC parameter of the first frame;

a vector quantizer that performs vector quantization of first parameters of the first frame to obtain encoded first parameters of the first frame, wherein the first parameters of the first frame include the calculated excitation signal power of the first frame and the calculated normalized predicted residual power of the first frame; and a multiplexer that multiplexes the encoded first parameters of the first frame with an encoded second parameter of a second frame to output the multiplexed data as second frame encoded data, wherein the encoded second parameter of the second frame includes the encoded LPC parameter of the second frame and the encoded excitation parameter of the second frame, wherein the normalized predicted residual power calculator calculates the normalized predicted residual power Pz(n) of frame n by $$Pz(n) = \prod_{j=1}^{M} (1 - r[j]^2)$$

where M is a prediction order and r[j] is a j-order reflection coefficient, wherein the encoded first parameters, multiplexed with the encoded second parameter by the multiplexer, are transmitted to a speech decoding apparatus, and the speech decoding apparatus calculates a synthesis filter gain adjustment coefficient from a ratio of a decoder normalized predicted residual power calculated in the speech decoding apparatus in an event of a frame loss and the normalized predicted residual power transmitted from the speech coding apparatus, wherein the synthesis filter gain adjustment coefficient is multiplied with the excitation signal to derive a decoded speech signal, and wherein each of the LPC analyzer, the LPC encoder, the excitation generator, the excitation parameter encoder, the excitation power calculator, the normalized predicted residual power calculator, the vector quantizer, and the multiplexer is implemented individually in integrated circuits.

2. The speech encoding apparatus according to claim 1, further comprising a pitch pulse detector that detects a pitch pulse, wherein the first parameters further include amplitude information of the detected pitch pulse.

3. The speech encoding apparatus according to claim 2, wherein the vector quantizer combines and quantizes as a vector at least two of the calculated excitation signal power, the calculated normalized predicted residual power, and the amplitude information of the detected pitch pulse.

4. The speech encoding apparatus according to claim 1, wherein the excitation power calculator calculates the excitation power of frame n, Pe(n), by $$Pe(n) = \frac{1}{\text{L_FRAME}} \sum_{i=0}^{L_FRAME-1} exc_n(i) * exc_n(i)$$

where L_FRAME is a frame length, i is a sample number and exc[i] is a speech signal of sample i.

5. A speech decoding apparatus comprising:

a decoder that receives a second frame encoded data including encoded first parameters of a first frame and an encoded second parameter of a second frame, which is transmitted from a speech encoding apparatus, the decoder decoding the encoded first parameters of the first frame to obtain the excitation signal power and the normalized predicted residual power calculated by the speech encoding apparatus, as a reference excitation power of the first frame and a reference normalized predicted residual power of the first frame, respectively;

an excitation power adjuster that adjusts power of an excitation signal generated by concealment processing when a first frame encoded data is lost, so as to match the reference excitation power of the first frame obtained by decoding the encoded first parameters of the first frame included in the second frame encoded data, where the first frame encoded data precedes the second frame encoded data;

a normalized predicted residual power calculator that calculates a normalized predicted residual power of a linear prediction coefficient generated by the concealment processing when the first frame encoded data is lost;

an adjustment coefficient calculator that calculates a filter gain adjustment coefficient from a ratio of the calculated normalized predicted residual power and the reference normalized predicted residual power of the first frame obtained by decoding the encoded first parameters of the first frame included in the second frame encoded data;

an adjuster that multiplies the excitation signal generated by the concealment processing by the calculated filter gain adjustment coefficient; and a synthesis filter that synthesizes a decoded speech signal using the linear prediction coefficient generated by the concealment processing and the excitation signal multiplied by the filter gain adjustment coefficient, wherein the normalized predicted residual power calculator calculates the normalized predicted residual power DPz(n) of frame n by $$DPz(n) = \prod_{j=1}^{M} (1 - dr[j]^2)$$

where M is a prediction order and dr[j] is a j-order reflection coefficient, wherein the excitation power adjuster calculates a phase-corrected excitation power of frame n, DPe(n), by $$DPe(n) = \frac{1}{\text{L_FRAME}} \sum_{i=0}^{L_FRAME-1} dpexc_n(i) * dpexc_n(i)$$

where L_FRAME is a frame length, i is a sample number and dpexc[i] is a pitch-pulse-corrected excitation signal of sample i, and the excitation power adjuster calculates an excitation power adjustment coefficient of frame n, re(n), by $$re(n)=\sqrt{Pe(n)/DPe(n)}$$

where Pe(n) is obtained by decoding an encoded first parameter of frame n, and the adjustment coefficient calculator calculates the filter gain adjustment coefficient of frame n, rz(n), by $$rz(n)=\sqrt{DPz(n)/Pz(n)}$$

where Pz(n) is obtained by decoding an encoded first parameter of frame n, and wherein each of the decoder, the excitation power adjuster, the normalized predicted residual power calculator, the adjustment coefficient calculator, the adjuster, and the synthesis filter is implemented individually in integrated circuits.

6. The speech decoding apparatus according to claim 5, wherein the decoder comprises:

a vector quantization decoder that decodes the encoded first parameters to obtain an average-removed logarithmic normalized predicted residual amplitude and an average-removed logarithmic excitation amplitude;

a first adder that adds a previously stored logarithmic normalized predicted residual amplitude average value to the average-removed logarithmic normalized predicted residual amplitude obtained by the vector quantization decoder, to obtain an added normalized predicted residual amplitude;

a first logarithmic inverse-converter that calculates a power of ten, with an exponent of the added normalized predicted residual amplitude obtained by the first adder, to obtain a linear domain amplitude;

a first power domain converter that obtains the reference normalized predicted residual power by calculating the square of the linear domain amplitude obtained by the first logarithmic inverse-converter;

a second adder that adds a previously stored logarithmic excitation amplitude average value to the average-removed logarithmic excitation amplitude obtained by the vector quantization decoder, to obtain an added excitation amplitude;

a second logarithmic inverse-converter that calculates a power of ten, with an exponent of the added excitation amplitude obtained by the second adder, to obtain a linear domain excitation amplitude; and a second power domain converter that obtains the reference excitation power by calculating the square of the linear domain excitation amplitude obtained by the second logarithmic inverse-converter, wherein each of the vector quantization decoder, the first adder, the first logarithmic inverse-converter, the first power domain converter, the second adder, the second logarithmic inverse-converter, the second power domain converter is included in at least one processor.

* * * * *